US011289823B2

(12) United States Patent
Chen et al.

(10) Patent No.: US 11,289,823 B2
(45) Date of Patent: Mar. 29, 2022

(54) ANTENNA AND ELECTRONIC DEVICE USING SAME

(71) Applicant: AAC Technologies Pte. Ltd., Singapore (SG)

(72) Inventors: Si Chen, Shenzhen (CN); Jing Wu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/995,836

(22) Filed: Aug. 18, 2020

(65) Prior Publication Data

US 2020/0412014 A1 Dec. 31, 2020

Related U.S. Application Data

(63) Continuation of application No. PCT/CN2019/093994, filed on Jun. 29, 2019.

(51) Int. Cl.

*H01Q 21/06* (2006.01)
*H01Q 1/48* (2006.01)
*H01Q 21/00* (2006.01)

(52) U.S. Cl.

CPC ..... *H01Q 21/061* (2013.01); *H01Q 1/48* (2013.01); *H01Q 21/0006* (2013.01); *H01Q 21/0075* (2013.01); *H01Q 21/0081* (2013.01); *H01Q 21/065* (2013.01)

(58) Field of Classification Search

CPC .. H01Q 21/061; H01Q 19/005; H01Q 21/065; H01Q 21/0075; H01Q 21/0081

See application file for complete search history.

(56) References Cited

U.S. PATENT DOCUMENTS

2016/0365638 A1* 12/2016 Luk ..... H01Q 9/285
2020/0295461 A1* 9/2020 Luk ..... H01Q 15/0093

OTHER PUBLICATIONS

Li et al. "A Low-Profile Substrate Integrated Magneto-Electric Dipole Antenna Based on Folded Magnetic Wall for UWB Application", 2018 IEEE/MTT-S International Microwave Symposium—IMS (pp. 1545-1548), Jun. 2018. (Year: 2018).*

* cited by examiner

*Primary Examiner* — Ricardo I Magallanes
(74) *Attorney, Agent, or Firm* — W&G Law Group

(57) ABSTRACT

The invention relates to an antenna and an electronic device. The antenna has a radiation part, a grounding sheet arranged separated from the radiation part and a number of ground connection parts. The radiation part has four radiators forming a first gap and a second gap. Each radiator is electrically connected to the grounding sheet through a ground connection part. The ground connection part includes at least an attaching sheet and a number of metal through holes. Each side of opposite two sides of each attaching sheet is electrically connected to at least one of the metal through holes. The electronic device includes the antenna. According to the technical scheme, the antenna has the advantage of low profile.

12 Claims, 5 Drawing Sheets

ANTENNA AND ELECTRONIC DEVICE USING SAME

FIELD OF THE PRESENT DISCLOSURE

The invention relates to the technical field of communication technologies, in particular to an antenna and an electronic device using such an antenna.

DESCRIPTION OF RELATED ART

The fifth generation mobile communication technology will change existing lifestyles of people hugely and promote social development continuously. An electromagnetic dipole antenna of a directional complementary antenna structure is combination of an electric dipole and a magnetic dipole, is very wide in bandwidth and has good directivity within working band, so that the electromagnetic dipole antenna is widely applied to base station antenna of mobile communication system. However, the antenna at present is relatively high in profile, and the demand on miniaturization of the antenna cannot be met.

Therefore, it is necessary to provide an improved antenna with a low profile to solve the problem mentioned above.

SUMMARY OF THE INVENTION

One of the main objects of the present invention is to provide an antenna with low profile.

Accordingly, the present invention provides an antenna having a radiation part, a grounding sheet arranged separated from the radiation part and a number of ground connection parts. The radiation part has four radiators forming a first gap and a second gap. Each radiator is electrically connected to the grounding sheet through a ground connection part. The ground connection part includes at least an attaching sheet and a number of metal through holes. Each side of opposite two sides of each attaching sheet is electrically connected to at least one of the metal through holes. The electronic device includes the antenna. According to the technical scheme, the antenna has the advantage of low profile.

In addition, the metal through hole connected to the radiator is near the first gap when the radiator is electrically connected to the attaching sheet through at least one of the metal through holes.

In addition, the attaching sheet comprises a first end and a second end opposite to the first end; the first end is near the first gap and the second end is far away from the first gap; and the metal through hole connected to one side of the attaching sheet is near the first end, and the metal through hole connected to the other side of the attaching sheet is near the second end.

In addition, the attaching sheets include a first attaching sheet and a second attaching sheet; the radiator, the first attaching sheet and the second attaching sheet are located in different planes parallel to each other; and the radiator is electrically connected to the grounding sheet successively through the metal through hole, the first attaching sheet, the metal through hole, the second attaching sheet and the metal through hole.

In addition, the antenna further comprises a feeding part feeding the radiation part, wherein an orthographic projection of the feeding part on the plane array is located in the second gap.

In addition, the feeding part comprises a feeding pin and a feeding arm, and the feeding pin is vertically connected to an end part of the feeding arm.

In addition, the feeding arm is located in a plane of the plane array.

In addition, the feeding part further comprises two feeding sheets which are electrically and fixedly connected to two ends of the feeding arm, separately.

In addition, the antenna further comprises a substrate, wherein the radiation part and the grounding sheet are separately arranged on two opposite surfaces of the substrate, and the feeding pin and the ground connection part are arranged in the substrate in a penetrating manner.

In addition, the invention further provides an electronic device, comprising an antenna as described above, wherein the electronic device is an intelligent terminal or an antenna base station.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

The terms first, second, third, fourth, and the like (if present) in the specification and claims of the present invention and the foregoing drawings are intended to distinguish like objects and are not necessarily intended to describe a particular order or sequence. It should be understood that the data so used can be interchanged at appropriate situation so that the embodiment described herein can be implemented in an order other than what is illustrated or described here. In addition, the terms "include" and "have" and any of their variations are intended to cover non-exclusive inclusion, for example, a process, method, system, product or device that contains a series of steps or units need not be limited to those steps or units that are clearly listed, but may include those that are not clearly listed or for those processes, methods, products Other steps or units inherent in products or equipment.

It should be noted that the descriptions referring to "first," "second," and the like in the present invention are for descriptive purposes only and are not to be construed as indicating or implying their relative importance or impliedly indicating the number of indicated technical features. Thus, a feature defined as "first" or "second" may include at least one such feature, either explicitly or implicitly. In addition, the technical scheme between embodiments can be combined with each other, but it must be based on the realization by the person of ordinary skill in the art, when the combination of the technical scheme is contradictory or cannot be realized, it should be considered that the combination of the technical scheme does not exist and is not within the scope of protection required by the invention.

Figure 1:
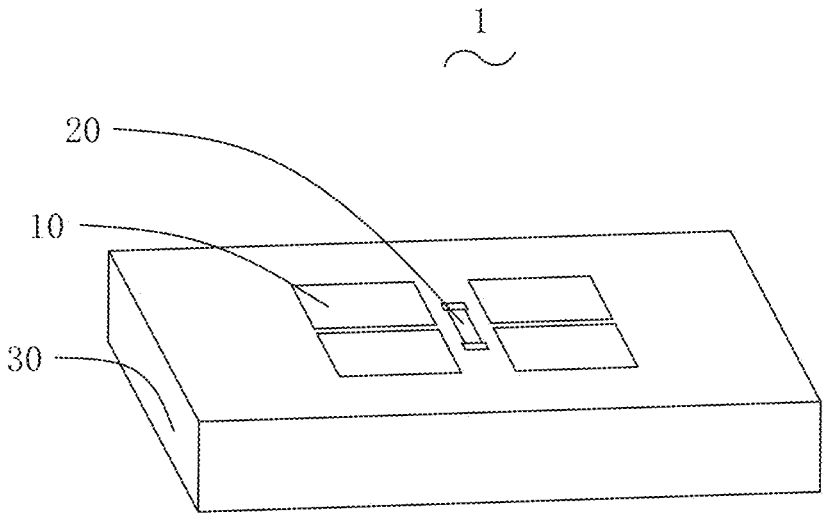
FIG. 1 is an isometric view of an antenna in accordance with an exemplary embodiment of the present invention.
Figure 2:
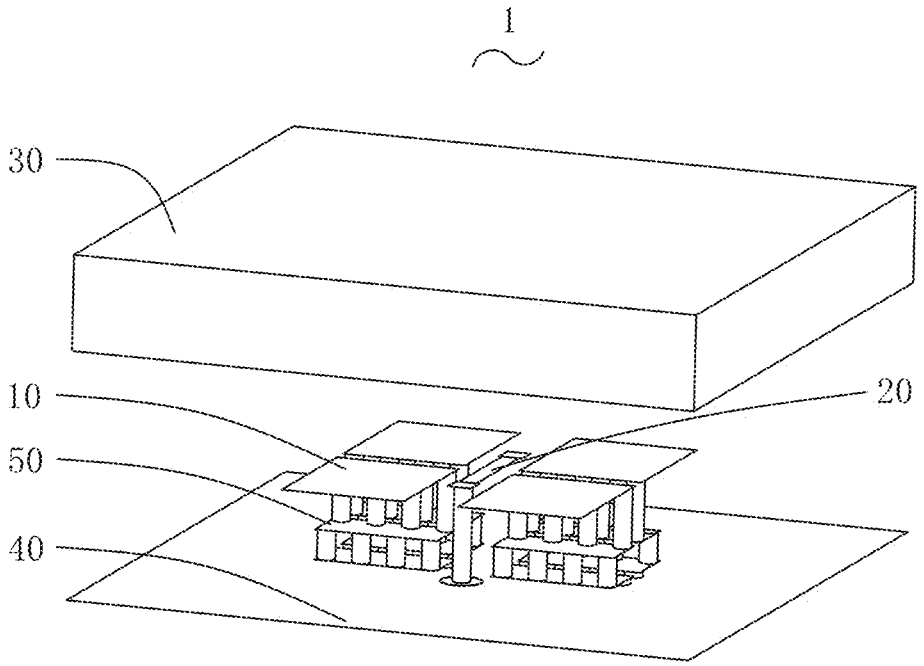
FIG. 2 is an exploded view of the antenna.

With reference to FIG. 1 and FIG. 2, the invention provides an antenna 1. The antenna 1 comprises a radiation part 10, a feeding part 20, a substrate 30, a grounding sheet 40 and a ground connection part 50. The radiation part 10, the substrate 30 and the grounding sheet 40 are overlapped successively, the ground connection part 50 is arranged in the substrate 30 in a penetrating manner, and the ground connection part 50 is used for connecting the radiation part 10 to the grounding sheet 40 electrically. Part of the feeding part 20 is arranged in the substrate 30 in a penetrating manner, and the feeding part 20 performs coupled feeding to the radiation part 10.

Figure 3:
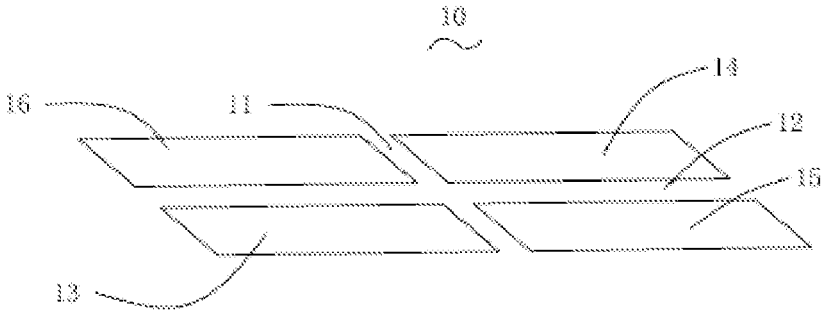
FIG. 3 is an isometric view of a radiation part of the antenna.

Referring to FIG. 3, the radiation part 10 comprises four radiators arranged in a 2×2 plane array, the radiators are spaced apart from each other to form a first gap 11 and a second gap 12 perpendicular to each other at the center of the plane array. Each radiator is electrically connected to the grounding sheet 40 through one ground connection part 50. The metal through hole connected to the radiator is near the first gap 11 when the radiator is electrically connected to the attaching sheet through at least one of the metal through holes. The four radiators are named the first radiator 13, the second radiator 14, the third radiator 15, and the fourth radiator 16 to distinguish them for easier description. The first radiator 13, the second radiator 14, the third radiator 15, and the fourth radiator 16 are provided on the same surface on the substrate 30.

In the present embodiment, the first radiator 13, the second radiator 14, the third radiator 15, and the fourth radiator 16 are provided on the surface of the substrate 30 away from the grounding sheet 40. Between the first radiator 13 and the third radiator 15 is the first gap 11, and between the second radiator 14 and the fourth radiator 16 is also the first gap 11; between the first radiator 13 and the fourth radiator 16 is the second gap 12, and between the second radiator 14 and the third radiator 15 is also the second gap 12. The radiation part 10 forms a working mode that the polarization mode is orthogonal. The metal through hole separately connected to the first radiator 13, the second radiator 14, the third radiator 15 and the fourth radiator 16 are near the first gap 11.

The grounding sheet 40 is used for grounding. The grounding sheet 40 and the radiation part 10 are respectively provided on the two opposite surfaces of the substrate 30. A hole can be formed in the grounding sheet 40 for the feeding part 20 to penetrate through.

Figure 4:
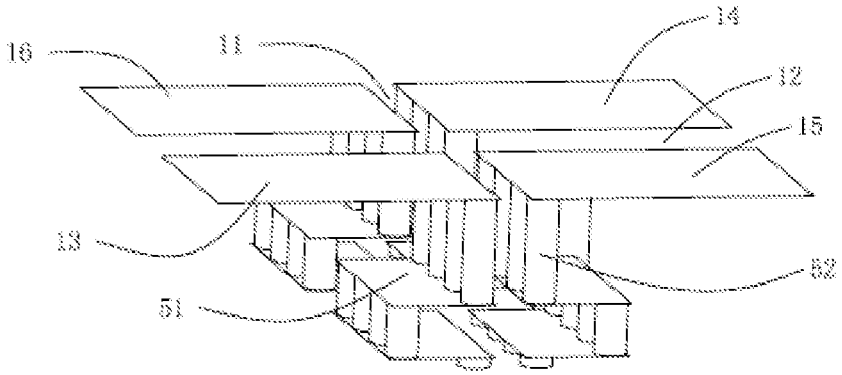
FIG. 4 is an illustration of the radiation part and a ground connection part of the antenna.
Figure 5:
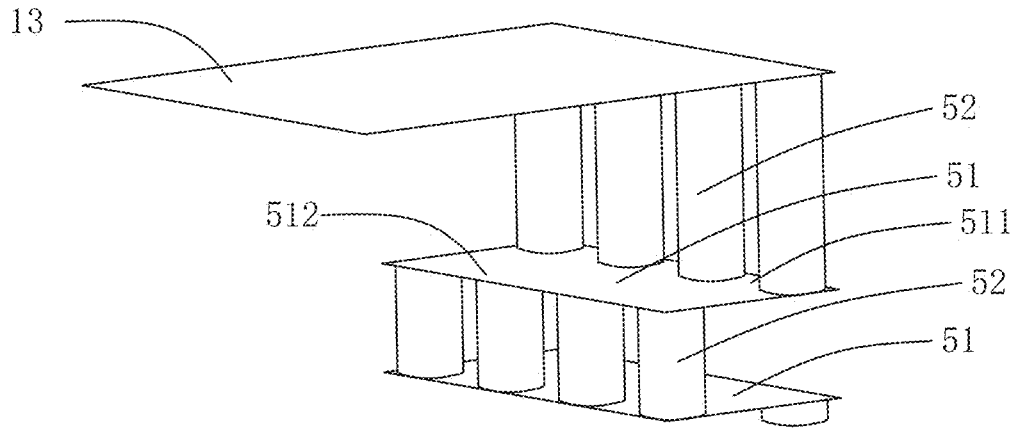
FIG. 5 is an illustration of a first radiator and the ground connection part provided by the embodiment of the invention.
Figure 6:
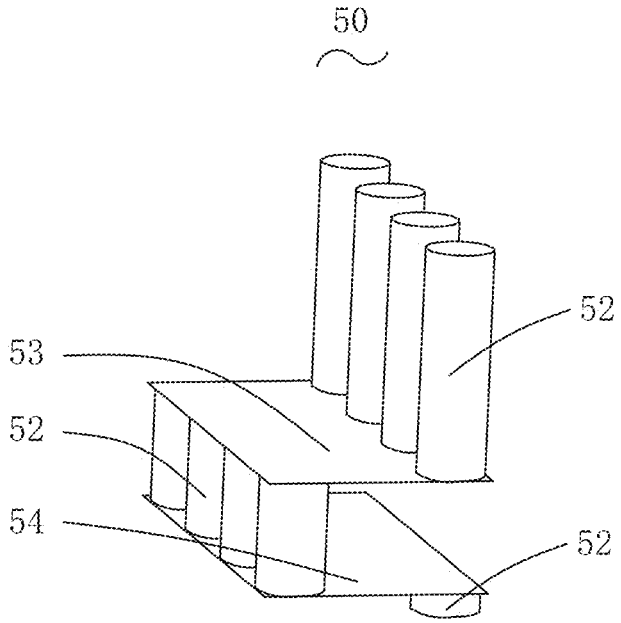
FIG. 6 is an isometric view of the ground connection part of the antenna.

With reference to FIG. 4, FIG. 5 and FIG. 6, the ground connection part 50 comprises at least one attaching sheet 51 and a plurality of metal through holes 52. The attaching sheets 51 and the metal through holes 52 are located between a plane array and the grounding sheet 40. At least one of the attaching sheet 51 and the radiators are located in different planes and are parallel to each other. Each side of opposite two sides of each attaching sheet 51 is electrically connected to at least one of the metal through holes 52, and each side of the attaching sheet 51 is electrically connected to adjacent radiator, attaching sheet 51 or grounding sheet 40 through at least one of the metal through holes 52.

The structures of the metal through holes 52 are not defined and it is appropriate that the metal through holes 52 can be electrically connected to the radiators, the grounding sheet 40 or the attaching sheets 51. For example, the metal through holes 52 can be hollow metal columns, solid metal columns and wires. Each radiator is electrically connected to the grounding sheet 40 through at least one of the metal through holes 52. In the embodiment, the metal through holes 52 can be solid metal columns and each radiator is electrically connected to the grounding sheet 40 through one metal through hole 52.

The attaching sheet 51 is sheet-like and the attaching sheet 51 can be conductive. The attaching sheet 51 comprises a first end 511 and a second end 512 which are opposite. The first end 511 is near the first gap 11, and the second end 512 is far away from the first gap 11. The metal through hole 52 connected to one side of the attaching sheet 51 is near the first end 511 and the metal through hole 52 connected to the other side of the attaching sheet 51 is near the second end 512. The quantity of the attaching sheets 51 is not defined. Specifically, when only one attaching sheet 51 is available, the attaching sheet 51 and the radiators are located in different planes and are parallel to each other, each side of opposite two sides of the attaching sheet 51 is electrically connected to at least one of the metal through holes 52, at least one of the metal through holes 52 in one side of the attaching sheet 51 is electrically connected to the radiator and at least one of the metal through holes 52 in the other side of the attaching sheet 51 is electrically connected to the grounding sheet 40.

When a plurality of attaching sheets 51 are available, the radiators and the attaching sheets 51 are located in different planes and are parallel to each other, each side of opposite two sides of the attaching sheet 51 is electrically connected to at least one of the metal through holes 52, at least one of the metal through holes 52 in the side, nearest to the radiator, of the radiating sheet 51 is electrically connected to the radiator, at least one of the metal through holes 52 in the side, nearest to the grounding sheet 40, of the radiating sheet 51 is electrically connected to the grounding sheet 40, and two adjacent radiating sheets 51 are electrically connected through at least one of the metal through holes 52.

In the embodiment, two attaching sheets are available: the first attaching sheet 53 and the second attaching sheet 54, separately. The radiator, the first attaching sheet 53 and the second attaching sheet 54 are located in different planes and are parallel to each other. The radiator is electrically connected to grounding sheet 40 through the metal through hole 52, the first attaching sheet 53, the metal through hole 52, the second attaching sheet 54 and the metal through hole 52 successively. Specifically, the radiator is electrically connected to the first end 511 of the first attaching sheet 53 through the metal through hole 52, the second end 512 of the first attaching sheet 53 is electrically connected to the second attaching sheet 54 through the metal through hole 52, and the first end 511 of the second attaching sheet 54 is electrically connected to the grounding sheet 40 through the metal through hole 52.

Figure 7:
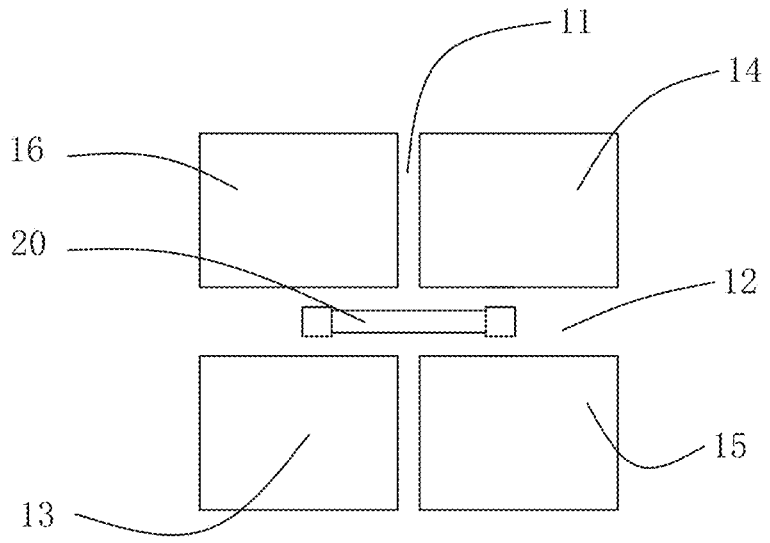
FIG. 7 is a top view of the radiation part and a feeding part of the invention.
Figure 8:
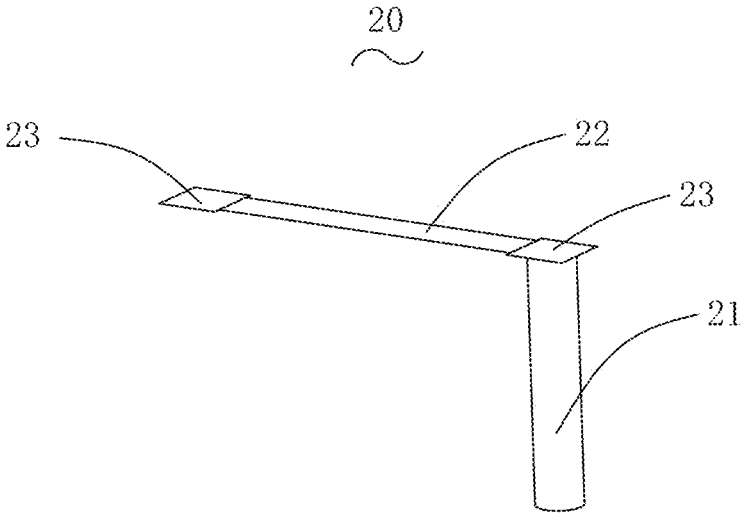
FIG. 8 is an isometric view of the feeding part of the invention.

With reference to FIG. 7 and FIG. 8, the orthographic projection of a feeding part 20 in the plane array is located in the second gap 12. The feeding part 20 comprises a feeding pin 21, a feeding arm 22 and feeding sheets 23. The feeding pin 21 is arranged in the substrate 30 in a penetrating manner, one end of the feeding pin 21 can penetrate the grounding sheet 40 to expose the feeding pin 21, so that the feeding pin 21 is electrically connected to an external radio frequency front end, the feeding pin 21 and the grounding sheet 40 are disconnected electrically, the feeding pin 21 is vertically connected to an end part of the feeding arm 22, and the feeding arm 22 and the feeding sheets 23 perform coupled feeding to the radiation part 10.

The shape of the feeding pin 21 is not defined. In the embodiment, the feeding pin 21 is cylindrical substantially. One end of the feeding pin 21 can be electrically connected to the external radio frequency front end and the other end of the feeding pin 21 is electrically connected to the feeding arm 22.

The feeding arm 22 is located in a plane of the plane array. The feeding arm 22 is located in the second gap 12. The feeding arm 22 is sheet-like and the feeding arm 22 is rectangular. The first end 511 of the feeding arm 22 is located between the first radiation assembly and the fourth radiation assembly, and the second end 512 of the feeding arm 22 is located between the second radiation assembly and the third radiation assembly. The feeding arm 22 and the feeding sheets 23 on the feeding arm 22 perform coupled feeding to the first radiator 13, the second radiator 14, the third radiator 15 and the fourth radiator 16.

Two feeding sheets 23 are arranged and two of the feeding sheets 23 are electrically and fixedly connected to two ends of the feeding arm 22, separately. The feeding sheets 23 are wider than the feeding arm 22. The feeding arm 22 and the feeding sheets 23 arranged at two ends of the feeding arm 22 are big at two ends and small in the middle. It can be understood that the feeding sheets 23 and the feeding arm 22 can be integrally formed or the feeding sheets 23 can be ignored.

It is to be noted that the metal through holes 52 separately connected to the first radiator 13, the second radiator 14, the third radiator 15 and the third radiator 15 are near the first gap 11; the first radiator, the ground connection part 50 and the fourth radiator connected to the first radiator 13 and the ground connection part 50 connected to the fourth radiator 16 are symmetrical about the second gap 12; the third radiator, the ground connection part 50 and the second radiator connected to the third radiator 15 and the ground connection part 50 connected to the second radiator 14 are symmetrical about the second gap 12; the first radiation assembly, the ground connection part 50 and the third radiation assembly connected to the first radiator 13 and the ground connection part 50 connected to the third radiator 15 are symmetrical about the first gap 11; and the fourth radiator, the ground connection part 50 connected to the fourth radiator 16 and the second radiator are symmetrical about the first gap 11.

A hole (not shown) can be formed in the substrate 30, so that other components such as the ground connection part 50 and the feeding pin 21 are arranged in a penetrating manner.

Figure 9:
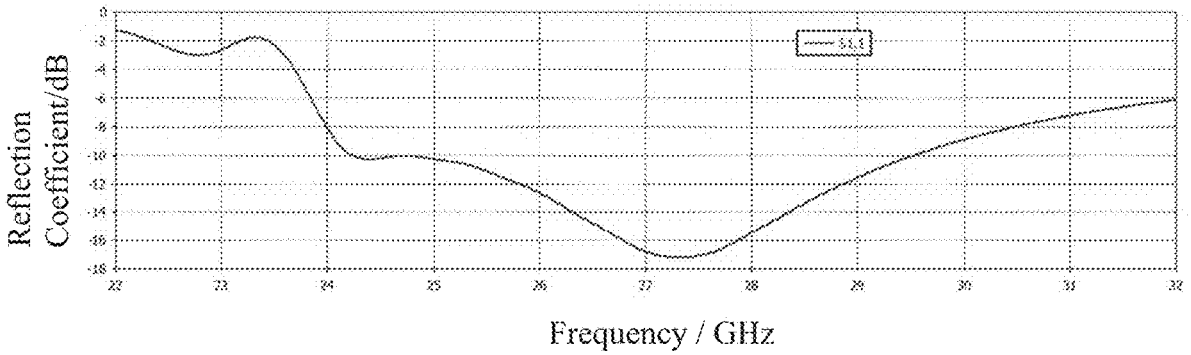
FIG. 9 is an S curve of the antenna.
Figure 10:
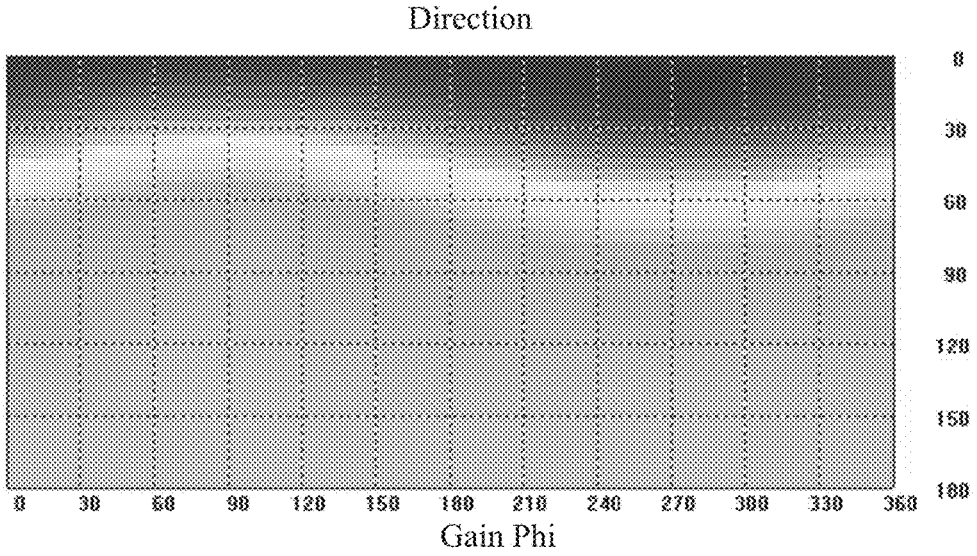
FIG. 10 is a direction view of the antenna of the invention.

Performance of the antenna 1 can be seen from FIG. 9 and FIG. 10. The antenna 1 is relatively low in profile and can cover wider frequency.

The invention further provides an electronic device which comprises the antenna 1. In an embodiment, the electronic device is an intelligent terminal or an antenna base station.

Relative to the prior art, in the embodiment of the invention, each radiator is electrically connected with the grounding sheet through one ground connection part; the ground connection part comprises at least one attaching sheet and a plurality of metal through holes; the attaching sheets and the metal through holes are positioned between the plane array and the grounding sheet; at least one attaching sheet and the radiators both are positioned on different planes and are parallel to each other; each of two opposite sides of each attaching sheet is electrically connected with at least one metal through hole; and each side of one attaching sheet is electrically connected with one adjacent radiator, one adjacent attaching sheet or the grounding sheet through at least one metal through hole, so that the profile of the antenna is reduced by the attaching sheets, the coverage band of the antenna is wider, the antenna is simple in structure and small in volume, and the demand for miniaturization of the antenna is met.

The antenna of the invention further comprises a substrate. The radiation part and the grounding sheet are separately arranged on two opposite surfaces of the substrate. The feeding pin and the ground connection parts are arranged in the substrate in a penetrating manner. Due to the presence of the substrate, the profile of the antenna is further reduced.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. An antenna, comprising:

a radiation part having four radiators distributed in a 2×2 plane array, the radiators being separated from each other for forming a first gap and a second gap perpendicular to each other at a center of the plane array;

a grounding sheet arranged separated from the radiation part;

a plurality of ground connection parts connecting the radiation part to the grounding sheet electrically, the ground connection part comprising at least one attaching sheet and a plurality of metal through holes located between the plane array and the grounding sheet;

a feeding part feeding the radiation part, comprising a feeding arm, a feeding pin vertically connected to an end part of the feeding arm and two feeding sheets electrically and fixedly connected to two ends of the feeding arm separately;

wherein each radiator is electrically connected to the grounding sheet through one ground connection part;

at least one of the attaching sheets and the radiators are located in different planes parallel to each other; each side of opposite two sides of each attaching sheet is electrically connected to at least one of the metal through holes;

and each side of the attaching sheet is electrically connected to adjacent radiator, attaching sheet or grounding sheet through at least one of the metal through holes;

an orthographic projection of the feeding part on the plane array is located in the second gap.

2. The antenna as described in claim 1, wherein the metal through hole connected to the radiator is near the first gap when the radiator is electrically connected to the attaching sheet through at least one of the metal through holes.

3. The antenna as described in claim 2, wherein the attaching sheet comprises a first end and a second end opposite to the first end; the first end is near the first gap and the second end is far away from the first gap; and the metal through hole connected to one side of the attaching sheet is near the first end, and the metal through hole connected to the other side of the attaching sheet is near the second end.

4. The antenna as described in claim 1, wherein the attaching sheets include a first attaching sheet and a second attaching sheet; the radiator, the first attaching sheet and the second attaching sheet are located in different planes parallel to each other; and the radiator is electrically connected to the grounding sheet successively through the metal through hole, the first attaching sheet, the metal through hole, the second attaching sheet and the metal through hole.

5. The antenna as described in claim 1, wherein the feeding arm is located in a plane of the plane array.

6. The antenna as described in claim 1, further comprising a substrate, wherein the radiation part and the grounding sheet are separately arranged on two opposite surfaces of the substrate, and the feeding pin and the ground connection part are arranged in the substrate in a penetrating manner.

7. An electronic device, comprising an antenna as described in claim 1.

8. An electronic device, comprising an antenna as described in claim 2.

9. An electronic device, comprising an antenna as described in claim 3.

10. An electronic device, comprising an antenna as described in claim 4.

11. An electronic device, comprising an antenna as described in claim 5.

12. An electronic device, comprising an antenna as described in claim 6.

* * * * *